US010665049B1

(12) United States Patent
Chang

(10) Patent No.: US 10,665,049 B1
(45) Date of Patent: May 26, 2020

(54) COUNTERFEIT PAPER CURRENCY DETECTOR

(71) Applicant: Top Vending Machine Electronics Co., Ltd., Taoyuan (TW)

(72) Inventor: Yuan-Fong Chang, Taoyuan (TW)

(73) Assignee: Top Vending Machine Electronics Co., Ltd., Taoyuan (TW)

( * ) Notice: Subject to any disclaimer, the term of this patent is extended or adjusted under 35 U.S.C. 154(b) by 0 days.

(21) Appl. No.: 16/391,478

(22) Filed: Apr. 23, 2019

(51) Int. Cl.
*G07D 7/121* (2016.01)
*G07D 7/128* (2016.01)
*G07D 11/22* (2019.01)
*G07D 11/16* (2019.01)

(52) U.S. Cl.
CPC ..... *G07D 7/121* (2013.01); *G07D 7/128* (2013.01); *G07D 11/16* (2019.01); *G07D 11/22* (2019.01); *G07D 2207/00* (2013.01)

(58) Field of Classification Search
CPC ..... G07D 7/121
USPC ..... 356/71
See application file for complete search history.

(56) References Cited

U.S. PATENT DOCUMENTS 5,903,339 A * 5/1999 Levasseur ..... G07D 7/121 250/555
2001/0030100 A1* 10/2001 Negishi ..... G07D 7/121 194/302
2003/0178282 A1* 9/2003 Bao ..... G06K 9/00 194/328
2004/0164248 A1* 8/2004 Nago ..... G07D 7/121 250/341.7
2005/0045449 A1* 3/2005 Nago ..... B65H 9/101 194/207
2005/0077215 A1* 4/2005 Nago ..... G07D 7/04 209/534
2005/0126880 A1* 6/2005 Iannello ..... G07F 7/04 194/206
2005/0126881 A1* 6/2005 Iannello ..... G07F 7/04 194/206
2008/0173832 A1* 7/2008 Chien ..... G07D 7/121 250/556
2011/0061988 A1* 3/2011 Lonsdale ..... G07D 7/12 194/303
2014/0291110 A1* 10/2014 Adachi ..... G07D 11/50 194/206

* cited by examiner

*Primary Examiner* — Tarifur R Chowdhury
*Assistant Examiner* — Omar H Nixon
(74) *Attorney, Agent, or Firm* — Alan D. Kamrath; Karin L. Williams; Mayer & Williams PC

(57) ABSTRACT

A counterfeit paper currency detector includes a casing receiving a delivering device, a driving device, and a paper currency detection device. The casing includes a paper currency inlet at an end thereof and a paper currency outlet at another end thereof and aligned with the paper currency inlet. The delivering device includes a delivering body having two ends intercommunicating with the paper currency inlet and the paper currency outlet, respectively. The driving device is mounted at upper and lower sides of the delivering body and is configured to drive a bill inputted via the paper currency inlet to move through the delivering body and then exit the paper currency outlet. The paper currency detection device is mounted to a rear end of the delivering device and is configured to examine whether the bill passing through the delivering body is a counterfeit bill.

7 Claims, 9 Drawing Sheets

COUNTERFEIT PAPER CURRENCY DETECTOR

BACKGROUND OF THE INVENTION

The present invention relates to a counterfeit paper currency detector and, more particularly, to a counterfeit paper currency detector with a smaller size and fewer components by arranging a delivering device, a driving device, and a paper currency detection device.

Paper currency detectors emit detection light to examine paper currency. Generally, a driving device drives a bill to pass through a passageway. A detection light transmitter and a detection light receiver are mounted on upper and lower sides of the passageway, respectively to examiner whether the bill is genuine.

In a conventional paper currency detector using this approach, since the transmission and reception of the detection light are perpendicular to the delivering direction of the bill, two circuit boards are required to electrically connect the detection light transmitter and the detection light receiver, respectively. This results in an increase in the number of components and additional wiring for the electrical connection and an increase in the volume of the counterfeit paper currency detector. It is, therefore, an important issue to solve these problems.

BRIEF SUMMARY OF THE INVENTION

The primary objective of the present invention is to provide a counterfeit paper currency detector including a driving device and a paper currency that are arranged in a direction the same as the delivering direction of a bill, significantly reducing the volume of the counterfeit paper currency detector.

The secondary objective of the present invention is to use a delivering device that permits the detection light transmitters and the detection light receivers, to proceed with transmission and reception of the detection light in the direction the same as the delivering direction, thereby simplifying the components and reducing the costs.

To achieve the above objectives, a counterfeit paper currency detector according to the present invention includes a casing, a delivering device, a driving device, and a paper currency detection device. The delivering device, the driving device, and the paper currency detection device are received in the casing. The casing includes a paper currency inlet at an end thereof and a paper currency outlet at another end thereof and aligned with the paper currency inlet. The delivering device includes a delivering body having two ends intercommunicating with the paper currency inlet and the paper currency outlet, respectively. The driving device is mounted at upper and lower sides of the delivering body and is configured to drive a bill inputted via the paper currency inlet to move through the delivering body and then exit the paper currency outlet. The paper currency detection device is mounted to a rear end of the delivering device and is configured to examine whether the bill passing through the delivering body is a counterfeit bill.

In an example, the casing includes a front cover and a rear cover coupled to the front cover. The paper currency inlet is located in the front cover. The paper currency outlet is located in the rear cover. A plurality of anti-pick hooks extends from an upper side and a lower side of the paper currency outlet.

In an example, the delivering body of the delivering device includes an upper board and a lower board. Two first upper light guiding members are disposed on two sides of the upper board, respectively. A plurality of second upper light guiding members is disposed between the two first upper light guiding members and is spaced from each other. Two first lower light guiding members are disposed on two sides of the lower board, respectively. A plurality of second lower light guiding members is disposed between the two first lower light guiding members and is spaced from each other.

The paper currency detection device includes a circuit board. Two first detection units are disposed on two sides of the circuit board, respectively. Each of the two first detection units includes a first detection light transmitter aligned with an associated one of the two first upper light guiding members and a first detection light receiver aligned with an associated one of the two first lower light guiding members. Each first detection light transmitter emits detection light which is directed by the associated one of the two first upper light guiding members to the associated one of the two first lower light guiding members which directs the detection light to an associated one of the first detection light receivers.

The circuit board includes a plurality of second detection units disposed between the two first detection units. Each of the plurality of second detection units includes a pair of second detection light transmitters corresponding to an associated one of the plurality of second upper light guiding members and a second detection light receiver located between the pair of second detection light transmitters. Each of the plurality of second detection units further includes a pair of third detection light transmitters corresponding to an associated one of the plurality of second lower light guiding members and a third detection light receiver located between the pair of third detection light transmitters.

Each second detection light transmitter emits detection light which is directed by the associated one of the plurality of second upper light guiding members to the associated one of the plurality of second lower light guiding members which directs the detection light to an associated one of the third detection light receivers. Each third detection light transmitter emits detection light which is directed by the associated one of the plurality of second lower light guiding members to the associated one of the plurality of second upper light guiding members which directs the detection light to an associated one of the second detection light receivers.

In an example, the circuit board includes a slot and two arms opposite to each other. Two detectors are disposed on the two arms, respectively. The delivering body is inserted between the slot and the two arms. Two sides of the delivering body are aligned with the two detectors.

In an example, the driving device includes a driver, a driving wheel unit, a front pressing wheel, and a rear pressing wheel. The driver is located above the delivering body. The driving wheel unit is connected to the driver and enters the delivering body from top of the delivering body. The front pressing wheel is located at a lower side of the delivering body, enters the delivering body from below the delivering body, and is aligned with the driving wheel unit. The rear pressing wheel is located adjacent to the paper currency outlet of the casing and is located below the driving wheel unit.

In an example, the driving wheel unit includes a front driving wheel located adjacent to the paper currency inlet, a rear driving wheel located adjacent to the paper currency outlet, and a transmission wheel. A belt is mounted around the transmission wheel, the front driving wheel, and the rear driving wheel. The front pressing wheel is aligned with the front driving wheel. The rear pressing wheel is aligned with the rear driving wheel.

In an example, the rear pressing wheel includes a shaft made of an elastic material, mounted to the casing, and located adjacent to the paper currency outlet. A bearing is mounted to the shaft. A pressing portion is mounted to the bearing.

In an example, the paper currency detection device further includes a counting detector mounted to a distal end of the delivering body adjacent to the paper currency outlet.

The present invention will become clearer in light of the following detailed description of illustrative embodiments of this invention described in connection with the drawings.

DETAILED DESCRIPTION OF THE INVENTION

Figure 1:
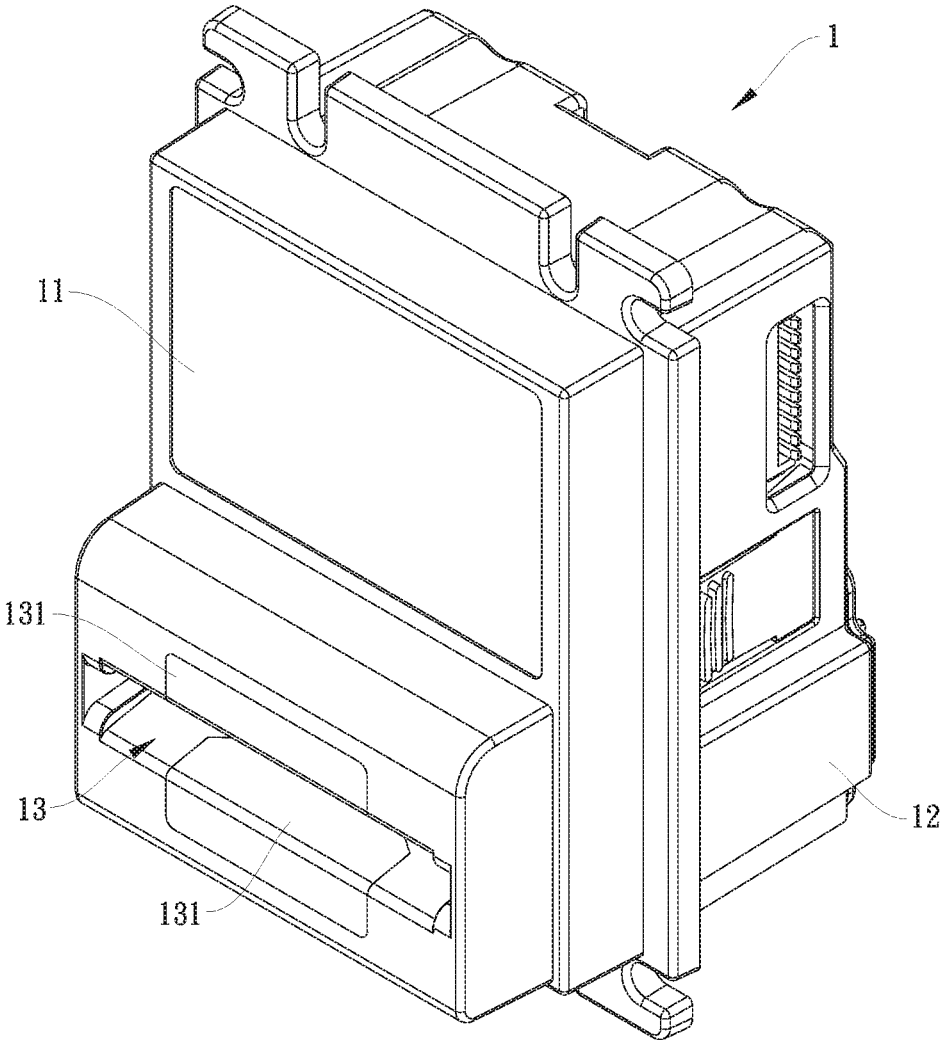
FIG. 1 is a perspective view of a counterfeit paper currency detector of an embodiment according to the present invention.
Figure 2:
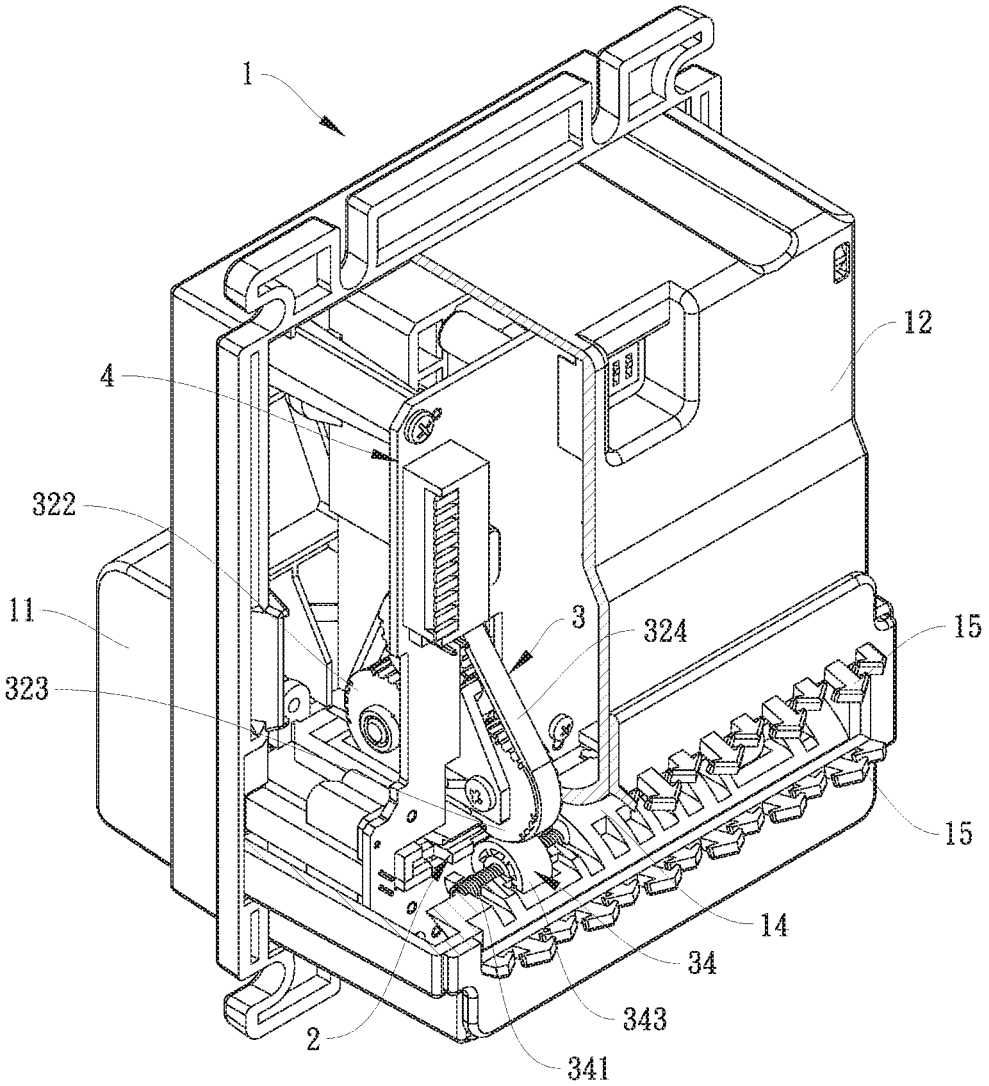
FIG. 2 is another perspective view of the counterfeit paper currency detector, with a portion of the counterfeit paper currency detector removed and with another portion of the counterfeit paper currency detector cut away.
Figure 3:
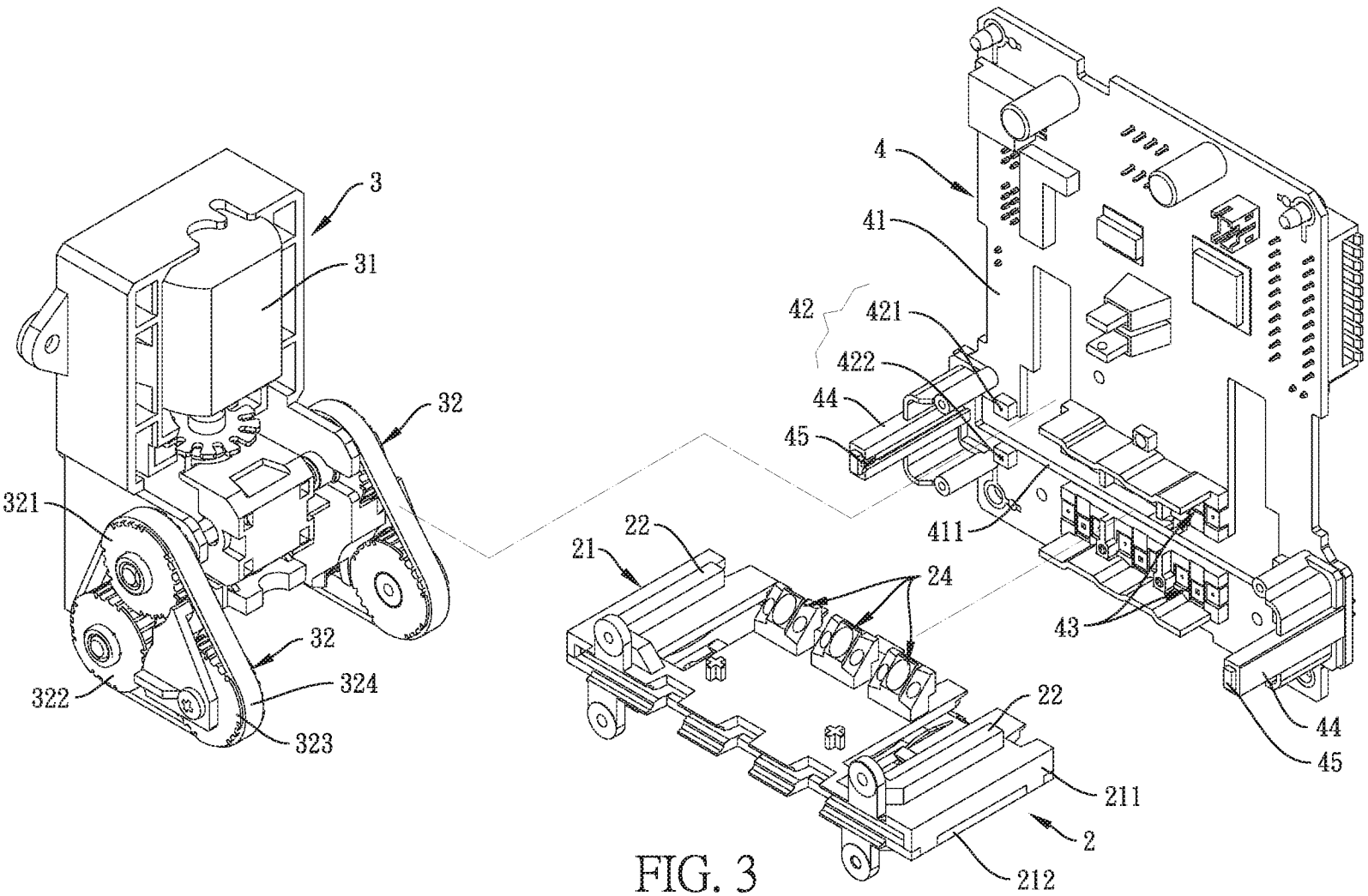
FIG. 3 is a partial, exploded, perspective view of the counterfeit paper currency detector.
Figure 4:
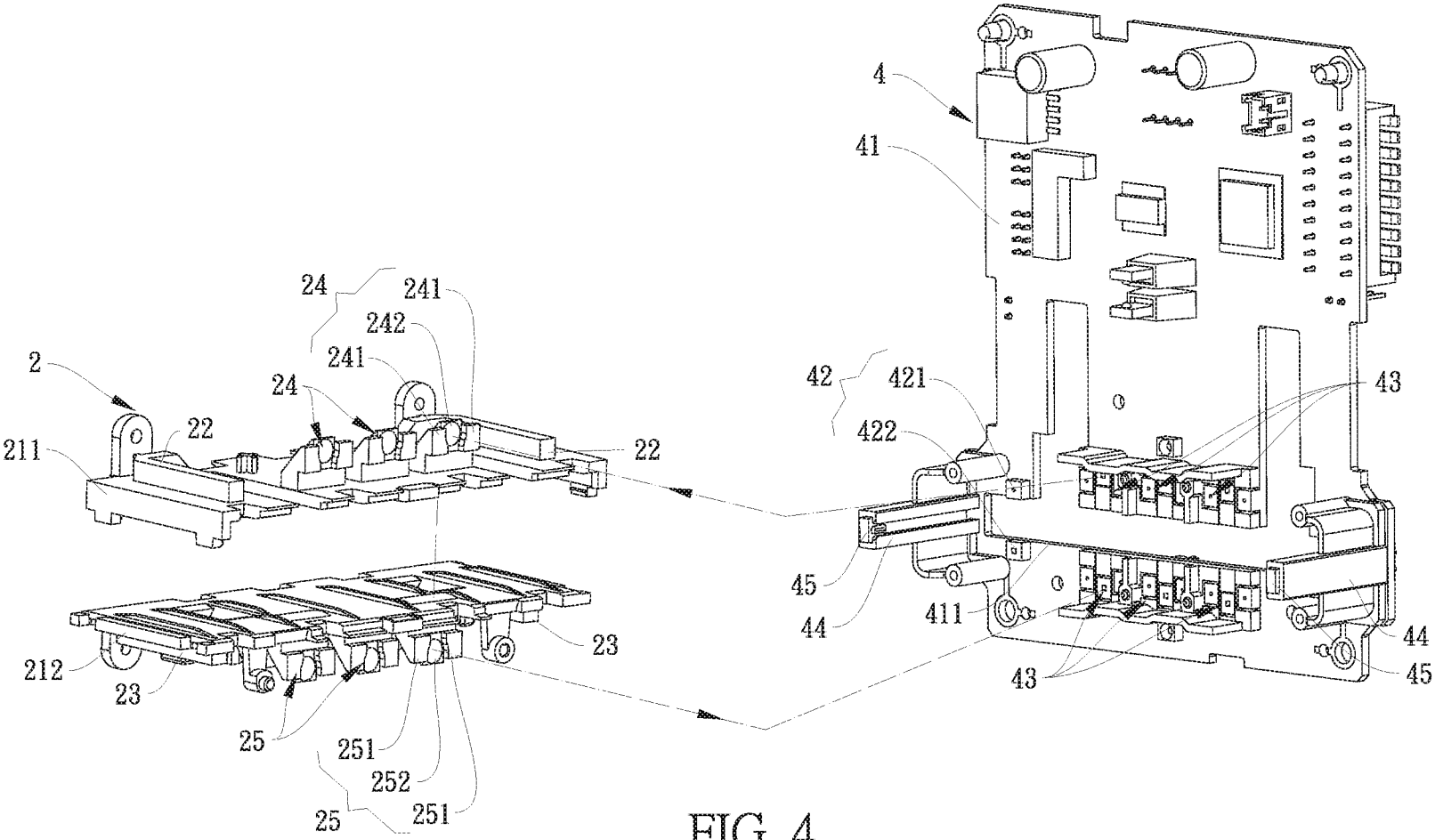
FIG. 4 is an exploded, perspective view of a delivering device and a paper currency detection device of the counterfeit paper currency detector.
Figure 5:
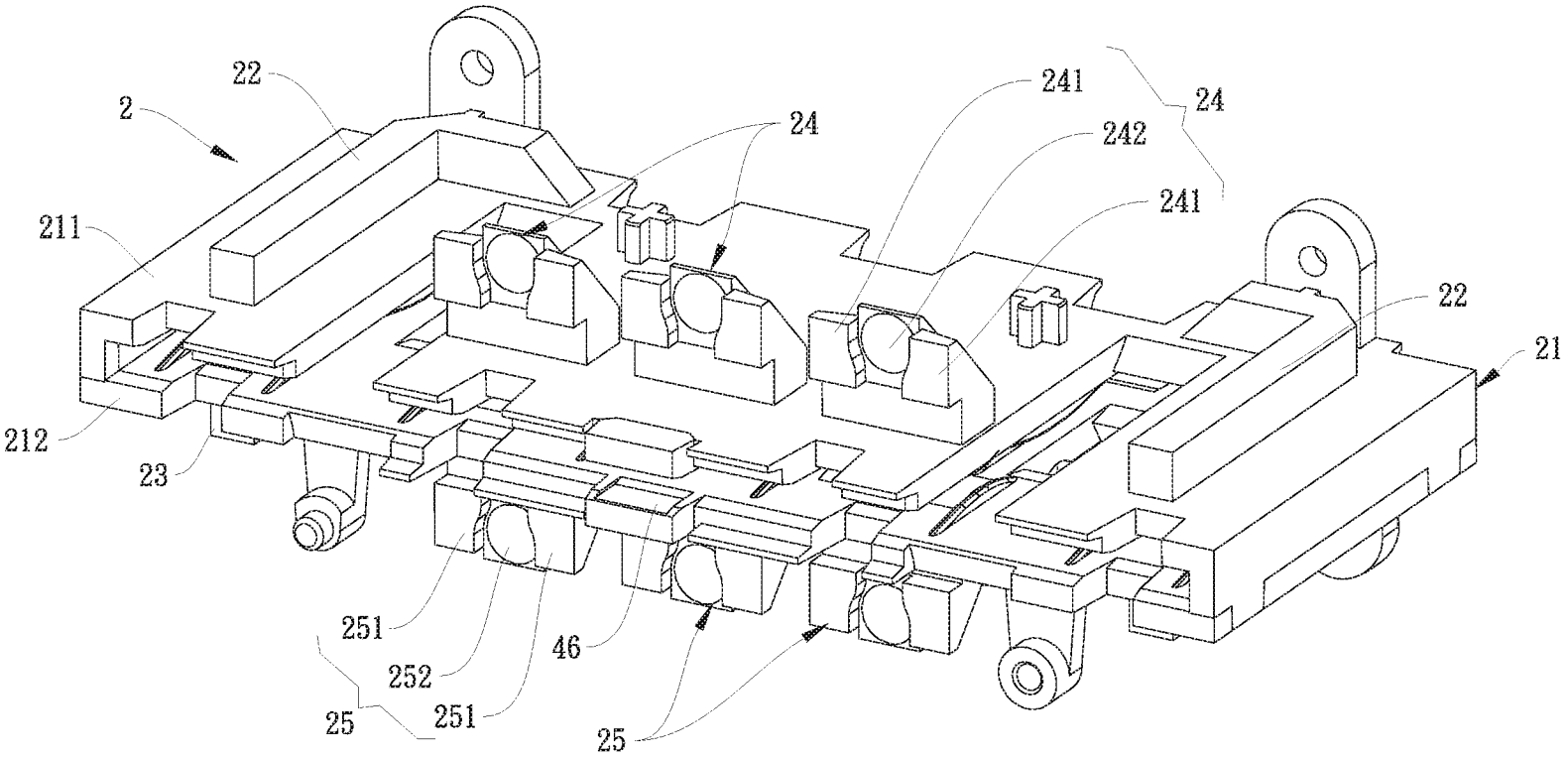
FIG. 5 is another perspective view of the delivering device.

With reference to FIGS. 1-6, a counterfeit paper currency detector according to the present invention includes a casing 1, a delivering device 2, a driving device 3, and a paper currency detection device 4. The delivering device 2, the driving device 3, and the paper currency detection device 4 are received in the casing 1.

The casing 1 includes a front cover 11 and a rear cover 12 coupled to the front cover 11. The front cover 11 includes a paper currency inlet 13. The rear cover 12 includes a paper currency outlet 14 aligned with the paper currency inlet 13. Two light guiding portions 131 are provided on upper and lower sides of the paper currency inlet 13. A plurality of anti-pick hooks 15 extends from an upper side and a lower side of the paper currency outlet 14, preventing a burglar from using a string to steal bills 5 (FIG. 6) passing through the casing 1.

The delivering device 2 includes a delivering body 21 having an upper board 211 and a lower board 212. The delivering body 21 includes two ends intercommunicating with the paper currency inlet 13 and the paper currency outlet 14, respectively. Two first upper light guiding members 22 are disposed on two sides of the upper board 211, respectively. Three second upper light guiding members 24 are disposed between the two first upper light guiding members 22 and are spaced from each other. Two first lower light guiding members 23 are disposed on two sides of the lower board 212, respectively. Three second lower light guiding members 25 are disposed between the two first lower light guiding members 23 and are spaced from each other. Each of the three second upper light guiding members 24 has two side guiding portions 241 and a middle guiding portion 242. Each of the three second lower light guiding members 25 has two side guiding portions 251 and a middle guiding portion 252.

The driving device 3 is mounted at upper and lower sides of the delivering body 21. The driving device 3 includes a driver 31, a driving wheel unit 32, a front pressing wheel 33, and a rear pressing wheel 34. The driver 31 is located above the delivering body 21 (FIG. 3) and can include a motor incorporating a worm and a worm gear. The driving wheel unit 32 includes a front driving wheel 322 located adjacent to the paper currency inlet 13, a rear driving wheel 323 located adjacent to the paper currency outlet 14, and a transmission wheel 321. A belt 324 is mounted around the transmission wheel 321, the front driving wheel 322, and the rear driving wheel 323. The front driving wheel 322 and the rear driving wheel 323 enter the delivering body 21 from top of the delivering body 21. The front pressing wheel 33 is located at a lower side of the delivering body 21, enters the delivering body 21 from below the delivering body 21, and is aligned with the front driving wheel 323. The rear pressing wheel 34 is located adjacent to the paper currency outlet 14 of the casing 1, is located at the lower side of the driving wheel unit 32, and is aligned with the rear driving wheel 323. The rear pressing wheel 34 includes a shaft 341 made of an elastic material (such as a spring), mounted to the casing 1, and located adjacent to the paper currency outlet 14. A bearing 342 is mounted to the shaft 231. A pressing portion 343 is mounted to the bearing 342.

The paper currency detection device 4 includes a circuit board 41 and a counting detector 46. The circuit board 41 is located at a portion of the driver 31 adjacent to the paper currency outlet 14. The circuit board 41 includes a slot 411 and two arms 44 opposite to each other. Two detectors 45 are disposed on the two arms 44, respectively. The delivering body 21 is inserted between the slot 411 and the two arms 41. Two sides of the delivering body 21 are aligned with the two detectors 45. The counting detector 46 is mounted to a distal end of the delivering body 21 adjacent to the paper currency outlet 14.

Two first detection units 42 are disposed on two sides of the circuit board 41, respectively. With respect to FIGS. 3-5 and 8, each of the two first detection units 42 includes a first detection light transmitter 421 aligned with an associated one of the two first upper light guiding members 22 and a first detection light receiver 422 aligned with an associated one of the two first lower light guiding members 23. The circuit board 41 includes three second detection units 43 disposed between the two first detection units 42. Each of the three second detection units 43 includes a pair of second detection light transmitters 431 corresponding to an associated one of the three second upper light guiding members 24 and a second detection light receiver 432 located between the pair of second detection light transmitters 431. Each of the three second detection units 43 further includes a pair of third detection light transmitters 433 corresponding to an associated one of the three second lower light guiding members 25 and a third detection light receiver 434 located between the pair of third detection light transmitters 433.

With reference to FIGS. 3-7, when a bill 5 is inputted via the paper currency inlet 13, the driver 31 drives the transmission wheel 321 to rotate, which, in turn, rotates the front driving wheel 322 and the rear driving wheel 323 via the belt 324. Furthermore, the front pressing wheel 33 and the rear pressing wheel 34 press against and drive the bill 5 to move through the delivering body 21 towards the paper currency outlet 14.

With reference to FIGS. 5-8, during movement of the bill 5 through the delivering body 21, each first detection light transmitter 421 emits detection light which is directed by the associated one of the two first upper light guiding members 22 towards the bill 5 and the associated one of the two first lower light guiding members 23 which directs the detection light to an associated one of the first detection light receivers 422.

Each second detection light transmitter 431 emits detection light which is directed by the associated side light guiding portion 241 of the associated one of the three second upper light guiding members 24 to the associated middle light guiding portion 252 of the associated one of the three second lower light guiding members 25. Then, the associated middle light guiding portion 252 directs the detection light to an associated one of the third detection light receivers 434. Furthermore, each third detection light transmitter 433 emits detection light which is reflected by the associated side light guiding portion 251 of the associated one of the three second lower light guiding members 25 to the bill 5 and the associated middle light guiding portion 242 of the associated one of the three second upper light guiding members 24. Then, the associated middle light guiding portion 242 directs the detection light to an associated one of the second detection light receivers 432.

Figure 6:
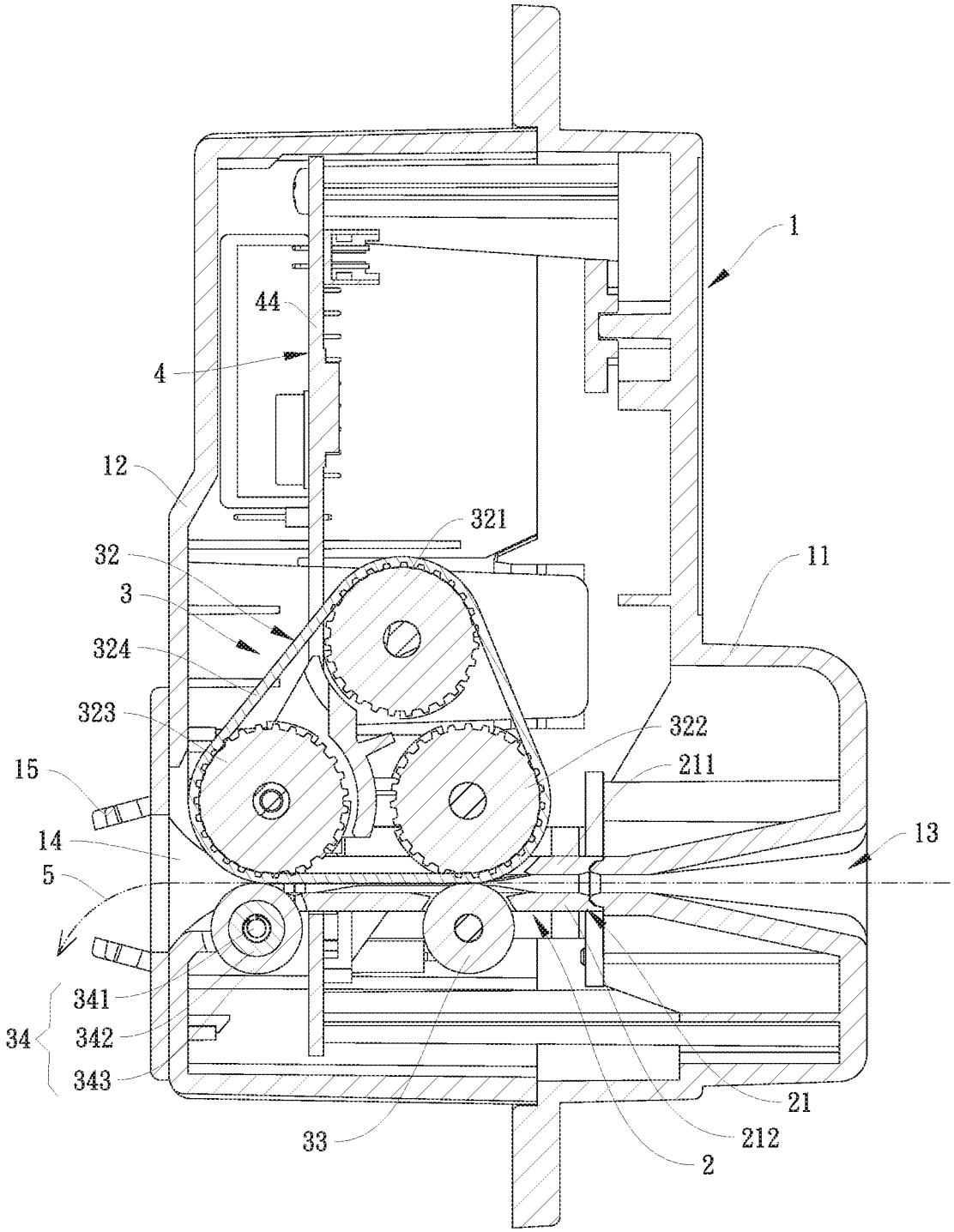
FIG. 6 is a cross sectional view of the counterfeit paper currency detector, illustrating delivering of a bill.
Figure 7:
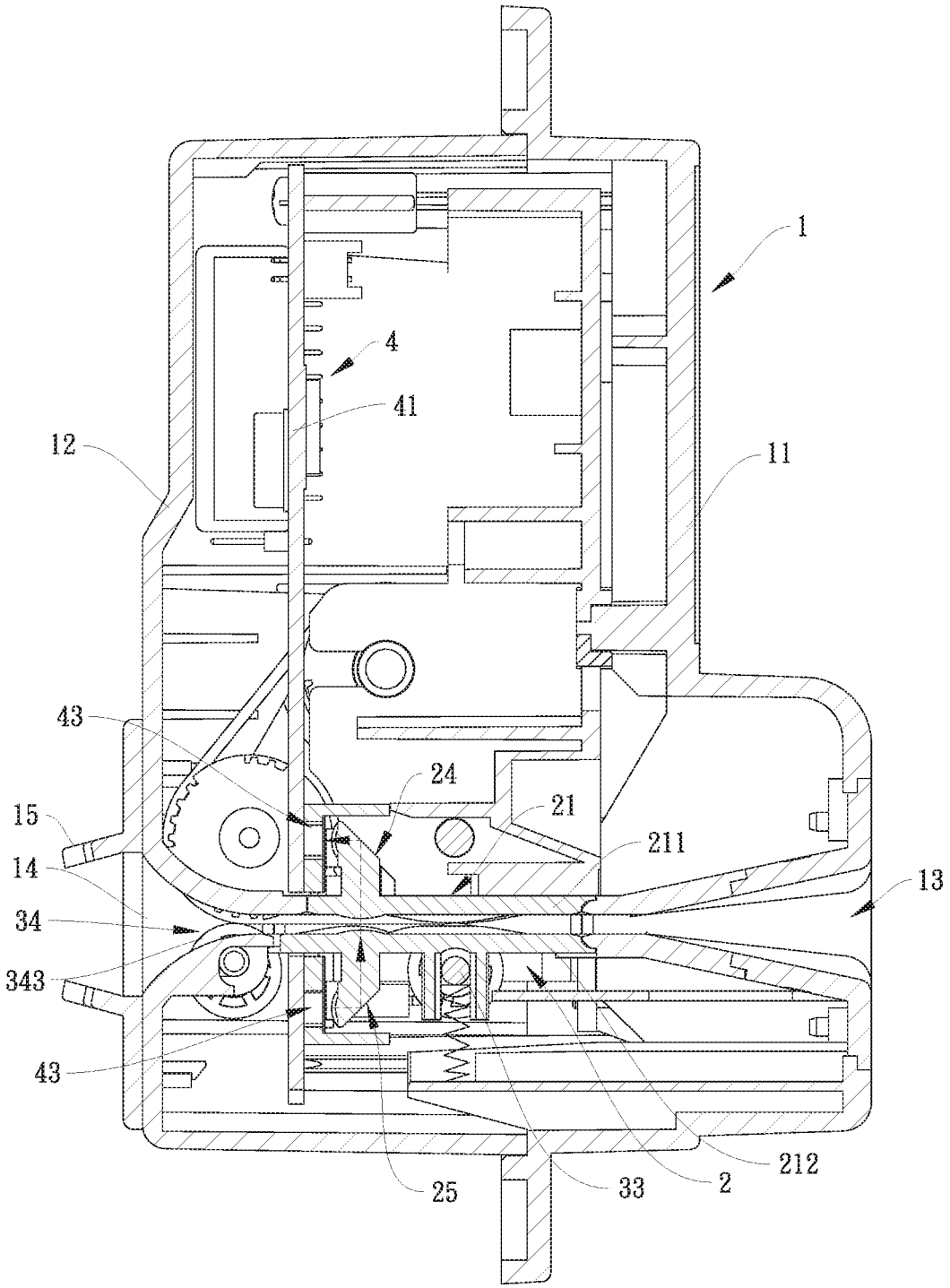
FIG. 7 is a cross sectional view illustrating detection of the bill.
Figure 8:
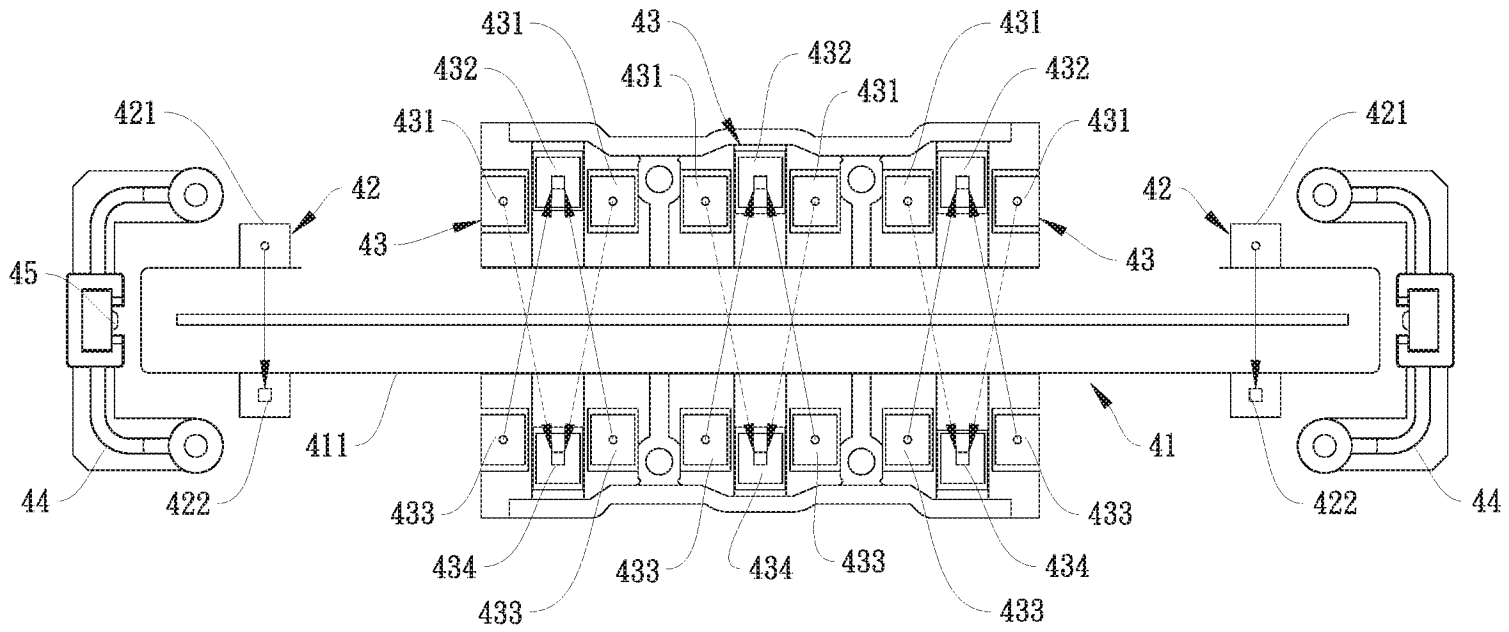
FIG. 8 is a side view illustrating a bill detection procedure.
Figure 9:
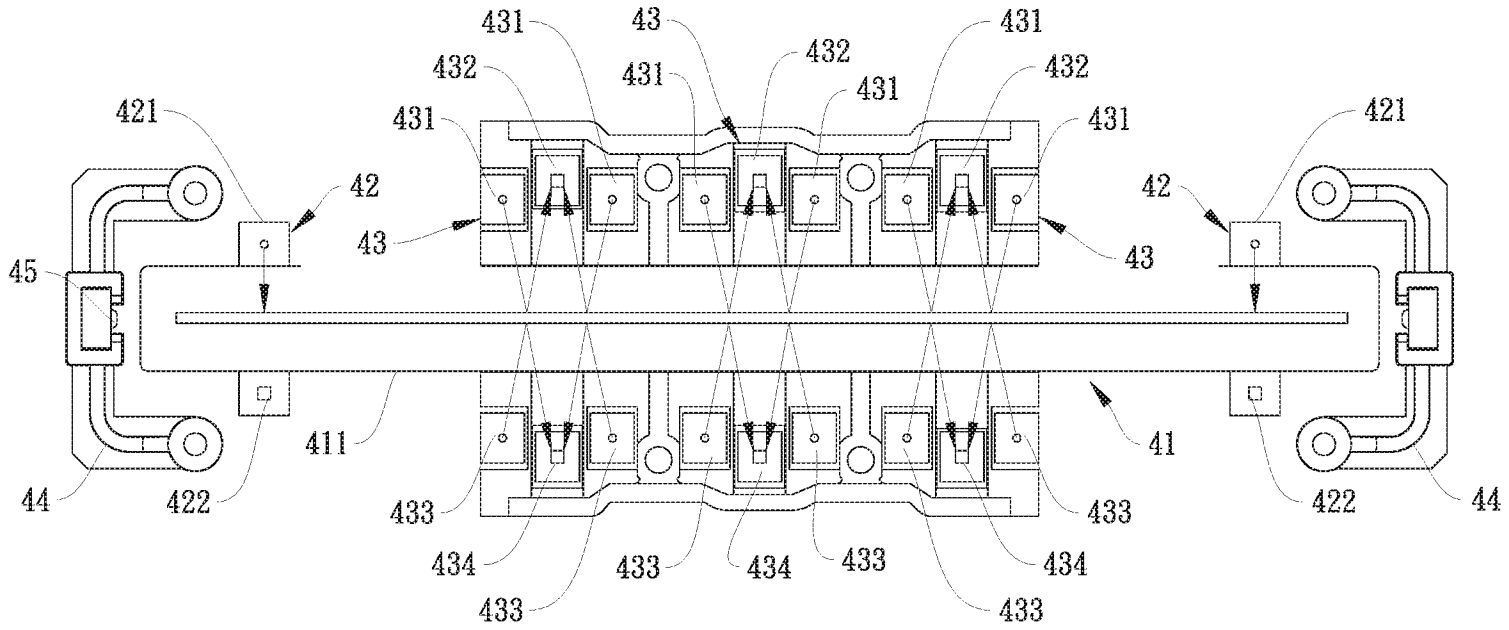
FIG. 9 is a side view illustrating another bill detection procedure.

When the detection light cannot transmit through a certain pattern portion of the bill 5, as shown in FIGS. 6 and 9, the detection light emitted by the first detection light transmitter 421 of each of the two first detection units 42 is blocked, and the detection light emitted by the second detection light transmitter 431 of each of the two second detection units 43 is refracted to the associated second detection light receiver 432. Furthermore, the detection light emitted by the third detection light transmitter 433 of each second detection unit 43 is refracted to the associated third detection light receiver 434. Thus, whether the bill 5 passing through the delivering body 21 is a counterfeit bill can be examined. When plural bills 5 have passed through the delivering body 21, the counting detector 46 can count the number of the bills 5. Furthermore, the detector 45 will detect whether the bills 5 are tied. If the bills 5 are tied by a string, an anti-picking procedure is activated for preventing the bills 5 from being stolen.

Although specific embodiments have been illustrated and described, numerous modifications and variations are still possible without departing from the scope of the invention. The scope of the invention is limited by the accompanying claims.

The invention claimed is:

1. A counterfeit paper currency detector comprising a casing, a delivering device, a driving device, and a paper currency detection device, wherein the delivering device, the driving device, and the paper currency detection device are received in the casing, characterized in that:

the casing includes a paper currency inlet at an end thereof and a paper currency outlet at another end thereof and aligned with and spaced from the paper currency inlet in a longitudinal direction, wherein the delivering device includes a delivering body having two ends intercommunicating with the paper currency inlet and the paper currency outlet, respectively, wherein the delivering body of the delivering device includes an upper board and a lower board spaced from the lower board in a vertical direction perpendicular to the longitudinal direction, wherein two first upper light guiding members are disposed on two sides of the upper board, respectively, wherein a plurality of second upper light guiding members is disposed between the two first upper light guiding members and is spaced from each other in the longitudinal direction, wherein each of the plurality of second upper light guiding members includes two side guiding portions and a middle guiding portion between the two side guiding portions thereof, wherein two first lower light guiding members are disposed on two sides of the lower board, respectively, wherein a plurality of second lower light guiding members is disposed between the two first lower light guiding members and is spaced from each other in the longitudinal direction, wherein each of the plurality of second lower light guiding members includes two side guiding portions and a middle guiding portion between the two side guiding portions thereof, wherein the driving device is mounted at upper and lower sides of the delivering body and is configured to drive a bill inputted via the paper currency inlet to move through the delivering body and then exit the paper currency outlet, wherein the paper currency detection device is mounted to a rear end of the delivering device and is configured to examine whether the bill passing through the delivering body is a counterfeit bill, wherein the paper currency detection device includes a circuit board, wherein two first detection units are disposed on two sides of the circuit board, respectively, wherein each of the two first detection units includes a first detection light transmitter aliened with an associated one of the two first upper light guiding members and a first detection light receiver aliened with an associated one of the two first lower light guiding members, wherein each first detection light transmitter emits detection light which is directed by the associated one of the two first upper light guiding members to the associated one of the two first lower light guiding members which directs the detection light to an associated one of the first detection light receivers, wherein a plurality of second detection units is disposed between the two first detection units and is spaced from each other in the longitudinal direction, wherein each of the plurality of second detection units includes a pair of second detection light transmitters corresponding to an associated one of the plurality of second upper light guiding members and a second detection light receiver located between the pair of second detection light transmitters, wherein each of the plurality of second detection units further includes a pair of third detection light transmitters corresponding to an associated one of the plurality of second lower light guiding members and a third detection light receiver located between the pair of third detection light transmitters, wherein each of the pair of second detection light transmitters emits the detection light which is directed by an associated one of the two side light guiding portions of an associated one of the plurality of second upper light guiding members to the middle light guiding portion of an associated one of the plurality of second lower light guiding members, wherein the middle light guiding portion of the associated one of the plurality of second lower light guiding members directs the detection light to an associated one of the third detection light receivers, wherein each of the pair of third detection light transmitters emits detection light which is reflected by an associated one of the two side light guiding portions of an associated one of the plurality of second lower light guiding members to the bill and the middle light guiding portion of an associated one of the plurality of second upper light guiding members, and wherein the middle light guiding portion of the associated one of the plurality of second upper light guiding members directs the detection light to the associated one of the second detection light receivers.

2. The counterfeit paper currency detector as claimed in claim 1, wherein the casing includes a front cover and a rear cover coupled to the front cover, wherein the paper currency inlet is located in the front cover, wherein the paper currency outlet is located in the rear cover, and wherein a plurality of anti-pick hooks extends from an upper side and a lower side of the paper currency outlet.

3. The counterfeit paper currency detector as claimed in claim 1, wherein the circuit board includes a slot and two arms opposite to each other, wherein two detectors are disposed on the two arms, respectively, wherein the two detectors are configured to detect whether the bill is tied, wherein the delivering body is inserted between the slot and the two arms, and wherein two sides of the delivering body are aligned with the two detectors.

4. The counterfeit paper currency detector as claimed in claim 1, wherein the driving device includes a driver, a driving wheel unit, a front pressing wheel, and a rear pressing wheel, wherein the driver is located above the delivering body, wherein the driving wheel unit is connected to the driver and enters the delivering body from top of the delivering body, wherein the front pressing wheel is located at a lower side of the delivering body, enters the delivering body from below the delivering body, and is aligned with the driving wheel unit, and wherein the rear pressing wheel is located adjacent to the paper currency outlet of the casing and is located below the driving wheel unit.

5. The counterfeit paper currency detector as claimed in claim 4, wherein the driving wheel unit includes a front driving wheel located adjacent to the paper currency inlet, a rear driving wheel located adjacent to the paper currency outlet, and a transmission wheel, wherein a belt is mounted around the transmission wheel, the front driving wheel, and the rear driving wheel, wherein the front pressing wheel is aligned with the front driving wheel, and wherein the rear pressing wheel is aligned with the rear driving wheel.

6. The counterfeit paper currency detector as claimed in claim 4, wherein the rear pressing wheel includes a shaft made of an elastic material, mounted to the casing, and located adjacent to the paper currency outlet, wherein a bearing is mounted to the shaft, and wherein a pressing portion is mounted to the bearing.

7. The counterfeit paper currency detector as claimed in claim 1, wherein the paper currency detection device further includes a counting detector mounted to a distal end of the delivering body adjacent to the paper currency outlet.

* * * * *